US005860588A

United States Patent [19]

Anchor

[11] Patent Number: 5,860,588

[45] **Date of Patent: *Jan. 19, 1999**

[54] STACKABLE GABLE TOP CARTON AND CORRESPONDING TOP INTERLOCKING CARTON BLANK

[75] Inventor: David R. Anchor, Itasca, Ill.

[73] Assignee: Tetra Laval Holdings & Finance, SA, Pully, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 766,493

[22] Filed: Dec. 13, 1996

[51] Int. Cl.[6] ..... B65D 5/08; B65D 5/74

[52] U.S. Cl. ..... 229/137; 229/125.42; 229/138; 229/184; 229/213; 229/214; 229/915.1; 229/935

[58] Field of Search ..... 229/137, 138, 229/184, 915.1, 213, 214, 125.42, 930, 933, 935, 210, 212, 132, 183

[56] References Cited

U.S. PATENT DOCUMENTS

| | | | |
|---|---|---|---|
| 2,412,666 | 12/1946 | Zinn et al. | 229/137 X |
| 3,244,353 | 4/1966 | Miessler, Sr. | 229/184 |
| 4,394,954 | 7/1983 | Lisiecki | 229/915.1 X |
| 4,568,018 | 2/1986 | Husnik | 229/915.1 |
| 4,753,832 | 6/1988 | Brown et al. | 229/3.1 X |
| 5,176,308 | 1/1993 | Frazier | 229/137 |
| 5,474,232 | 12/1995 | Ljungstrom et al. | 229/184 |

FOREIGN PATENT DOCUMENTS

| | | | |
|---|---|---|---|
| 276893 | 8/1988 | European Pat. Off. | 229/138 |

*Primary Examiner*—Stephen J. Castellano
*Assistant Examiner*—Niki M. Eloshway
*Attorney, Agent, or Firm*—Michael A. Catania

[57] ABSTRACT

A gable-top carton and a corresponding carton blank are set forth. The upstanding fin of the carton comprises a centrally disposed depressed region that facilitates stacking of the cartons on top of one another in a manner that results in a more even load distribution on the fins of the lower cartons than obtained when stacking conventional gable-top cartons. A further advantage is realized in the corresponding carton blanks in that the corresponding blanks may be disposed in a top-to-top manner along the width of a web of material whereby savings in material and production costs results.

4 Claims, 8 Drawing Sheets

STACKABLE GABLE TOP CARTON AND CORRESPONDING TOP INTERLOCKING CARTON BLANK

BACKGROUND OF THE INVENTION

Gable top cartons have been known for the better part of the twentieth century. Their characteristic simplicity and resealability have helped to sustain their popularity as containers for traditional liquid food products such as milk and juice, but in recent years they have been used for products ranging from ammunition to Epsom salts.

Gable-top containers are manufactured from container blanks that are comprised of a flexible laminate which includes a carrier layer of paper between external liquid-tight plastic layers. Stacks of such blanks are supplied to the packaging machine, usually at an input magazine. The blanks have previously been folded and side-sealed so that they obtain a substantially square cross-section when erected within the packaging machine. These blanks are fed individually to the input of the packaging machine where the blanks are formed, filled, and sealed to produce a gable-top container that is filled with product.

The blanks from which the gable-top containers are manufactured are in the form of material sheets which have been detached from a continuous web of packaging material and have been given an outer contour which is adapted to provide the required size and shape of the finished container. For a gable-top container, the blanks have a substantially four-sided configuration in which two parallel lateral edges are straight and define the sides of the blank while a further pair of parallel transverse edges are irregular and define the top and bottom of the blank. The non-uniform edges make it difficult, if not impossible, to establish a rational cutting of the blades edge-in-edge with each other. As such, there is an appreciable amount of waste material associated with the cutting of the blanks from the continuous web of material. This not only brings about increased material costs, but also renders the manufacturing of the blanks difficult since the excess material that is continuously generated during the production process must be removed in a manner which does not interfere with the production process.

One reference addressing the problem of wasted material is U.S. Pat. No. 4,655,386, to Billberg. The '386 patent is directed to a packaging container, such as a gable-top container, which is provided with partly straight, parallel lateral edges, and partly transverse edges which are indented according to a regular pattern which is repeated over the width of the blank. As a result of the indentations, the edges of the blanks can be cut and formed without substantial waste.

When fully folded, filled, and sealed, the known blanks, such as the type disclosed in the '386 patent, form a gable top carton that includes a gabled top structure, including an upstanding fin. The gable top structure engages a plurality of side panels. Traditionally, each side panel is generally perpendicular to each adjacent side panel. The panels are each divided from one another by a single vertical score line extending the entire height of the sidewall. These side panels form the characteristic hollow rectangular body of the container and define the volume of product that a carton can hold.

Such gable-top containers containing product are frequently transported in standard-sized crates. Low volume gable-top containers are thus often transported in the same size crates as used to transport the high volume gable-top containers. In the case of the low volume gable-top containers, however, the containers are stacked within the generally standard-sized crates whereby the upstanding fin of a lower gable-top container engages the bottom of the gable-top container immediately above it.

The present inventor has disclosed a gable-top container having an upstanding fin and a corresponding interlocking container blank. The gable-top container can be readily stacked and can be formed from an interlocking container blank that substantially reduces the amount of material wasted in the blank manufacturing process.

BRIEF SUMMARY OF THE INVENTION

A gable-top carton and a corresponding carton blank are set forth. The upstanding fin of the carton comprises a centrally disposed depressed region that facilitates stacking of the cartons on top of one another in a manner that results in a more even load distribution on the fins of the lower cartons than obtained when stacking conventional gable-top cartons. A further advantage is realized in the corresponding carton blanks in that the corresponding blanks may be disposed in a top-to-top manner along the width of a web of material whereby savings in material and production costs results.

DETAILED DESCRIPTION OF THE INVENTION

Figure 1:
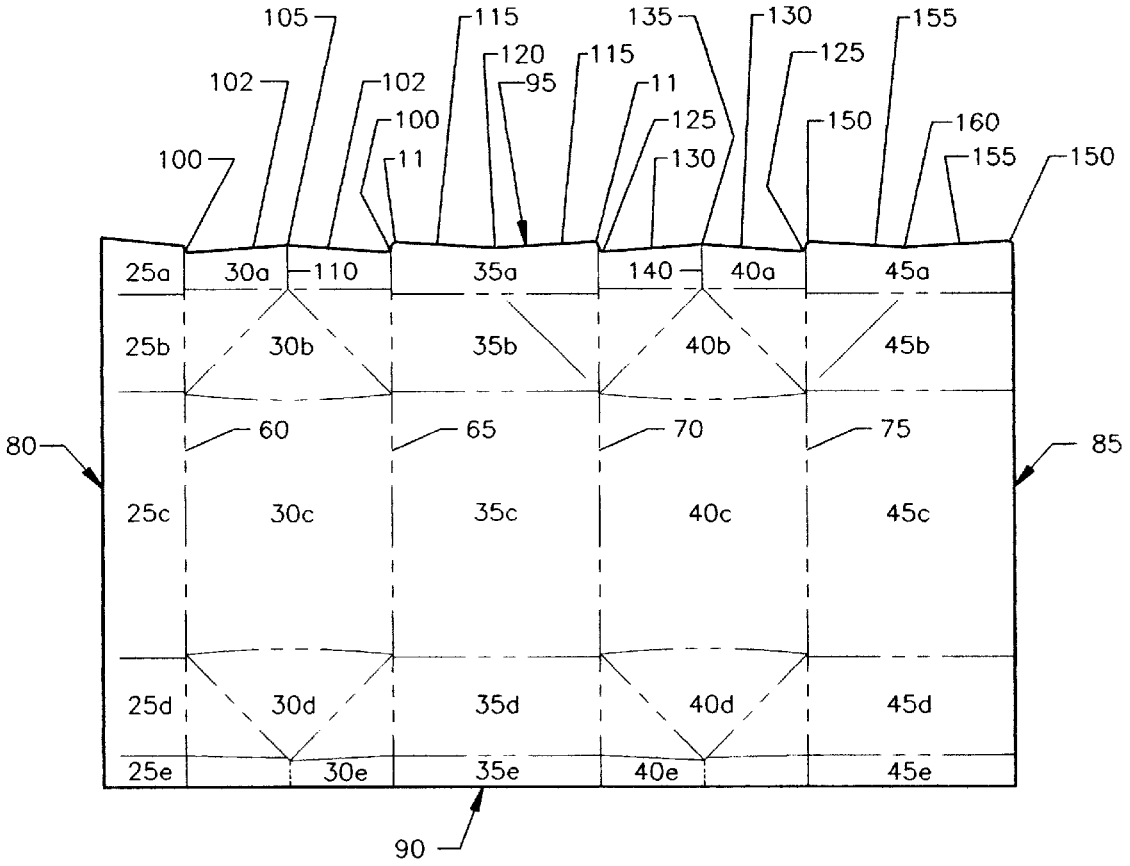
FIG. 1 is a plan view of one embodiment of a carton blank constructed in accordance with the present invention.

FIG. 1 illustrates one embodiment of a blank that may be used to form a carton in accordance with the teachings of the present invention. The carton blank 20 has a plurality of panels that are effectively separated from one another by a plurality of vertical and horizontal score lines. As viewed along the horizontal direction, the plurality of panels include first vertical panel sections 25*a–e*, second vertical panel sections 30*a–e*, third vertical panel sections 35*a–e*, fourth vertical panel sections 40*a–e,* and fifth vertical panel sections 45*a–e* that are respectively divided from one another by vertical score lines 60, 65, 70, and 75. The first panel sections 25*a–e* have a smaller width than the other panel sections. As viewed along the vertical direction, the plurality of panels include top fin panels 25*a*, 30*a*, 35*a*, 40*a*, and 45*a*, top flaps 25*b*, 30*b*, 35*b*, 40*b*, and 45*b*, side panels 25*c*, 30*c*, 35*c*, 40*c*, and 45*c*, bottom flaps 25*d*, 30*d*, 35*d*, 40*d*, and 45*d*, and bottom fin panels 25*e*, 30*e*, 35*e*, 40*e*, and 45*e*.

In accordance with the embodiment illustrated in FIG. 1, the lateral edges 80 and 85 forming the sides of the blank are defined by straight cuts. Similarly, the lower transverse edge 90 forming the lower edge of the blank 20 is defined by a straight cut.

As illustrated, the upper transverse edge 95 forming the upper edge of the blank 20 is defined by an irregular cut. To this end, the portion of the transverse edge 95 of the top fin panel 25*a* slopes downward from lateral edge 80 to vertical score line 60. The portions of the transverse edge 95 of the top fin panel 30*a* adjacent the vertical score lines 60 and 65 are curved to define concave recessed sections 100. A pair of inclined edges 102 extend between the concave recessed sections 100 and join together at an apex 105. A vertical score line 110 extends from the apex 105 and bisects the top fin panel 30*a*.

The portions of the transverse edge 95 of the top fin panel 35*a* adjacent the vertical score lines 65 and 70 are curved outwardly to define convex sections 112. A pair of declined edges 115 extend between the convex sections 112 and join one another at a depressed section 120 disposed generally at a central portion of the top fin panel 35*a* at which the top fin panel 35*a* has a decreased width.

The portions of the transverse edge 95 of the top fin panel 40*a* adjacent the vertical score lines 70 and 75 are curved to define concave recessed sections 125. A pair of inclined edges 130 extend between the concave recessed sections 125 and join together at an apex 135. A vertical score line 140 extends from the apex 135 and bisects the top fin panel 40*a*.

The portions of the transverse edge 95 of the top fin panel 45*a* adjacent the vertical score line 75 and lateral edge 85 are curved outwardly to define convex sections 150. A pair of declined edges 155 extend between the convex sections 150 and join one another at a depressed section 160 disposed generally at a central portion of the top fin panel 45*a*. The depressed section 160 is formed by a narrowing of the top fin panel 45*a*.

Figure 2:
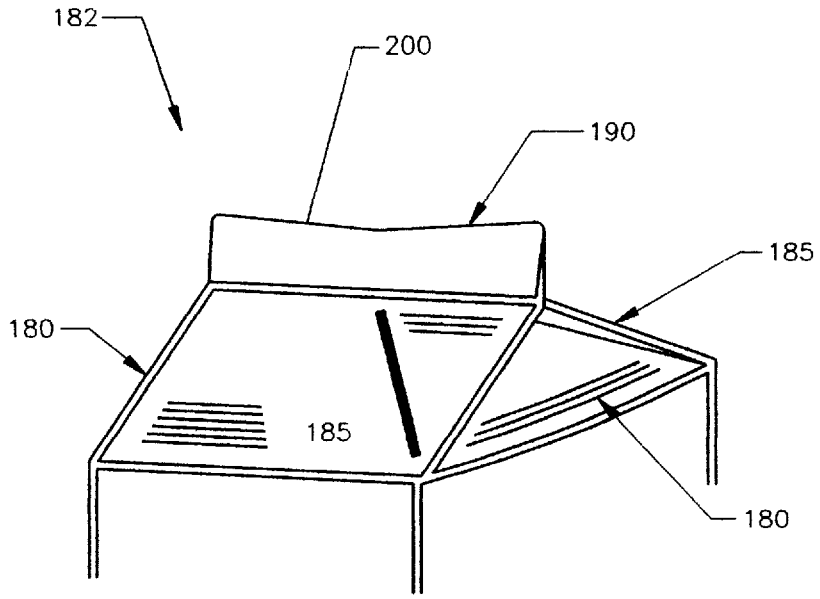
FIG. 2 is a perspective view of a top of a carton constructed from the blank of FIG. 1.

As will be understood by those familiar with the folding of gable-top containers, the top fin panels 25*a*–45*a* and the top flaps 25*b*–45*b* fold to form the familiar gable top structure of the container. To this end, and as illustrated in FIG. 2, top flaps 30*b* and 40*b* are folded toward one another to form underlying sections 180 of the top gable structure while top flaps 35*b* and 45*b* are folded toward one another to form overlying sections 185 of the top gable structure 182. Top fin panels 30*a* and 40*a* are each folded about their respective vertical score lines 110 and 140 toward one another and form the interior layers of the fin 190 of the gable structure 182. Top fin panels 35*a* and 45*a* are disposed exterior to the top fin panels 30*a* and 40*a* and form the exterior layers of the fin 190.

As will be further evident, the score lines defining these top panels and top flaps may take on a wide range of configurations. Such configurations include at least those illustrated in FIG. 1, the configurations shown in U.S. Pat. No. 5,474,232, the configurations shown in U.S. Ser. No. 08/620,698, filed Mar. 21, 1996, and the configurations shown in the '386 patent referenced above.

A plurality of horizontally disposed score lines divide the top flaps 25*b*–45*b* from side panels 25*c*–45*c*. The score lines dividing the top flaps 25*b*, 35*b*, and 45*b* from side panels 25*c*, 35*c*, and 45*c* lie generally along the same horizontal axis, while score lines dividing the top flaps 30*b* and 40*b* from side panels 30*c* and 40*c* lie generally along a further horizontal axis that is displaced therefrom. The score lines dividing the top flaps 30*b* and 40*b* from the side panels 30*c* and 40*c* are preferably curved score lines. The use of such curved score lines is disclosed in our U.S. Pat. No. 5,474,232, issued Dec. 12, 1995, hereby incorporated by reference. Such curved score lines allow the carton to be designed with a low profile gable top without a corresponding reduction in its functionality (i.e., without a reduction in the ability to open the carton). By employing a low profile gable top, the vertical dimensions of the top flaps 25*b*–45*b* may be reduced over conventional gable-top containers to thereby reduce the surface area of the carton.

A further plurality of horizontally disposed score lines divide the side panels 25*c*–45*c* from the bottom flaps 25*d*–45*d*. The score lines dividing the side panels 25*c*, 35*c*, and 45*c* from the bottom flaps 25*d*, 35*d*, and 45*d* lie generally along the same horizontal axis, while the score lines dividing the side panels 30*c* and 40*c* from bottom flaps 30*d* and 40*d* lie generally along a further different horizontal axis. The score lines dividing side panels 30*c* and 40*c* from bottom flaps 30*d* and 40*d* are curved score lines. The use of such curved score lines allows the carton to be designed with a gabled bottom/fin structure. Further details and advantages of such a configuration are set forth in the referenced '232 patent.

The embodiment of FIG. 1 includes a bottom gabled structure having a fin. To this end, a fourth plurality of horizontally disposed score lines divide the bottom flaps 25*d*–45*d* from the bottom fin panels 25*e*–45*e*. The score lines dividing the bottom flaps 25*d*, 35*d*, and 45*d* from the bottom fins 25*e*, 35*e*, and 45*e* lie generally along the same horizontal axis. To facilitate formation of the gabled bottom structure, the second and fourth bottom flaps 30*d* and 40*d* each include a pair of diagonal score lines that each converge at a respective apex. Each respective apex, for example, may converge at the horizontal score lines dividing the respective bottom fin panel 30*e* and 40*e* from the bottom flap 30*d* and 40*d*. The score lines dividing the second and fourth bottom flaps 30*d* and 40*d* from the corresponding bottom fin panels 30*e* and 40*e* are angled in the illustrated manner and converge at the apex of the diagonal score lines of the corresponding bottom flap.

FIG. 2 illustrates the top of a carton formed from the blank 20. As illustrated, the carton top includes a gabled structure 182 formed from the top fin panels 25*a*–45*a* and the top flaps 25*b*–45*b*. The gable structure 182 comprises the upstanding fin 190. The upstanding fin 190 comprises a depression 200 that is disposed proximate a central portion as gauged along the length of the fin 190. As will become apparent from the description below, the precise position of the depression 200 along the length of the fin 190 is dependent on the position of any ridge or bowing disposed at the bottom of the container to thereby facilitate stacking of the containers in a crate.

Those familiar with the folding of gable-top containers will recognize that the bottom flaps 25*d*–45*d* and bottom fin panels 25*e*–45*e* form the bottom of the container. In the illustrated embodiment, the bottom structure is constructed by first forming a bottom gabled structure from the bottom flaps 25*d*–45*d* and bottom fin panels 25*e*–45*e*. The resulting bottom gabled structure is then urged into a recess that is defined by the curved score lines. Further details concerning the formation of this bottom structure can be found in the referenced '232 patent.

Figure 3:
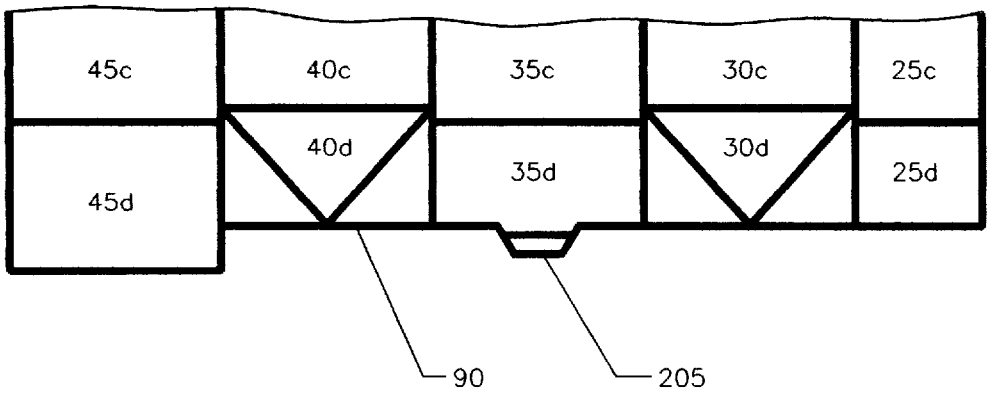
FIG. 3 is a partial view of an alternative bottom configuration for the blank of FIG. 1.

The bottom structure, however, may take on any number of configurations. One such bottom configuration is illustrated in FIG. 3. The bottom configuration illustrated in FIG. 3 differs from the bottom configuration of the blank 20 of FIG. 1. No bottom fin panels are utilized in the embodiment of FIG. 3. Additionally, the score lines dividing the second side panel 30*c* and fourth side panel 40*c* from the second bottom flap 30*d* and fourth bottom flap 40*d*, respectively, are each generally straight, as opposed to curved. The apices of the converging diagonal score lines of the second and fourth bottom flaps 30*d* and 40*d* are disposed a distance from the horizontal bottom edge of the blank. Bottom flap 45*d* is generally longer than the other bottom flaps 25*d*–40*d*. Bottom flap 35*d* preferably includes an extension tab 205 that, when folded, is disposed at the interior of the container to assist in preventing wicking of the product into the paperboard carrier layer.

Figure 4:
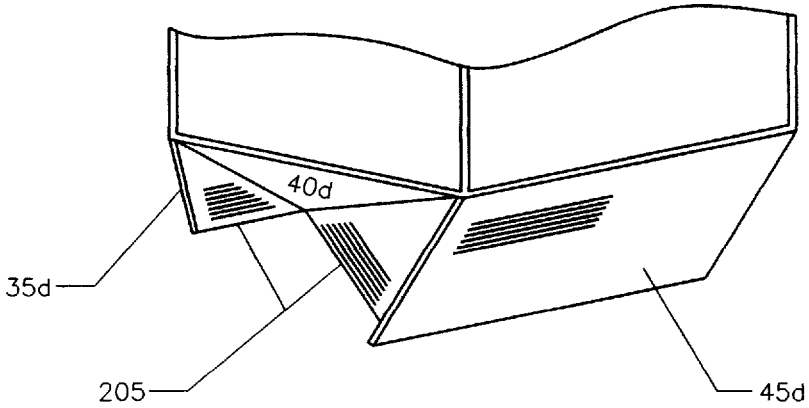
FIGS. 4 and 5 illustrate the folding of the bottom configuration of the blank of FIG. 3.
Figure 5:
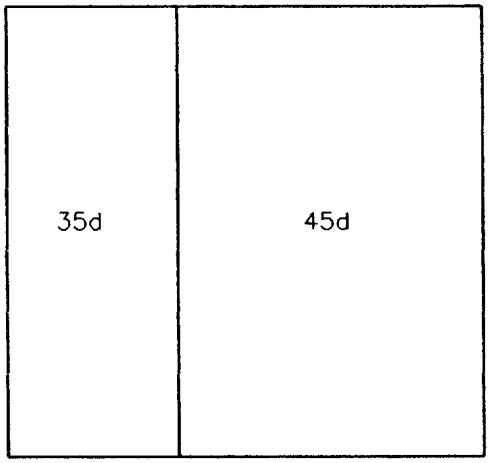

FIGS. 4 and 5 illustrate the folding of the bottom configuration of a carton formed from the blank of FIG. 3. As illustrated, bottom flaps 30*d* and 40*d* are folded toward one another and bottom flaps 35*d* and 45*d* are likewise folded toward one another. Bottom flaps 35*d* and 45*d* overlie bottom flaps 30*d* and 40*d*. The extended portion of bottom flap 45*d* is folded to overlie bottom flap 35*d*. The overlapped portion of bottom flap 45*d* is sealed to the bottom flap 35*d* by, for example, heat sealing the flaps together. It will be recognized that the bottom flap 35*d* may be extended in lieu of extension of bottom flap.

In each of the foregoing bottom structures, a central ridge is formed which tends to extend from the otherwise flattened bottom of the container. Additionally, or in the alternative, the bottom structures may bow slightly outward This bottom ridge and/or bowing does not generally increase the difficulty of transporting the containers in a crate when only a single layer of containers are disposed therein. The ridge and/or bowing, however, does tend to generate some difficulties when more than a single layer of containers are stacked in the crate.

Figure 6:
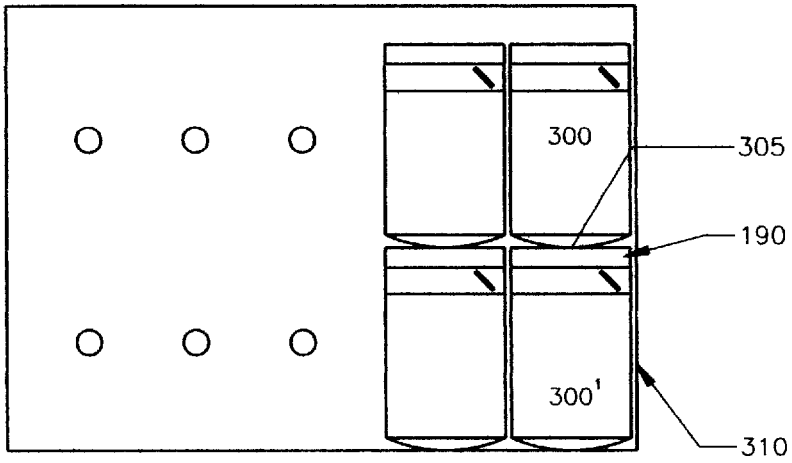
FIGS. 6 and 7 illustrate the stacking of conventional containers in a crate and the stacking of containers constructive in accordance with the teachings of the invention.

With reference to FIG. 6, the difficulty of stacking one gable-top container 300 having a bottom ridge or bowing 305 on top of a further gable-top container 300' having an upstanding fin 190 is illustrated. As shown, the bottom ridge or bowing 305 acts as a fulcrum with respect to the upstanding fin 190. This lever action results in a mechanical instability between the upper container 300 and the lower container 300' that makes the upper container 300 susceptible to tipping, particularly during manual unloading of a crate 310 containing the cartons. Additionally, the localized loading of the fin results in increased wear of the fin thereby making the lower container more susceptible to leaking.

Figure 7:
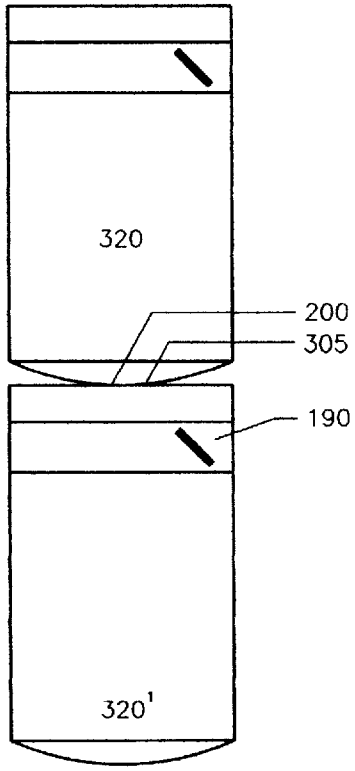

FIG. 7 illustrates the stacking of an upper container 320 having a bottom ridge or bowing 305 on top of a lower container 320' having an upstanding fin 190 formed from a blank having a top configuration such as the one shown in FIG. 1 above. As illustrated, the fin 190 comprises a centrally disposed depressed region 200 which facilitates a more even distribution of the load of the upper container 320 on the upstanding fin 190 of the lower container 320'. This improved load distribution results in a stacking arrangement that is significantly more mechanically stable than the stacked configuration shown in FIG. 6.

Figure 8:
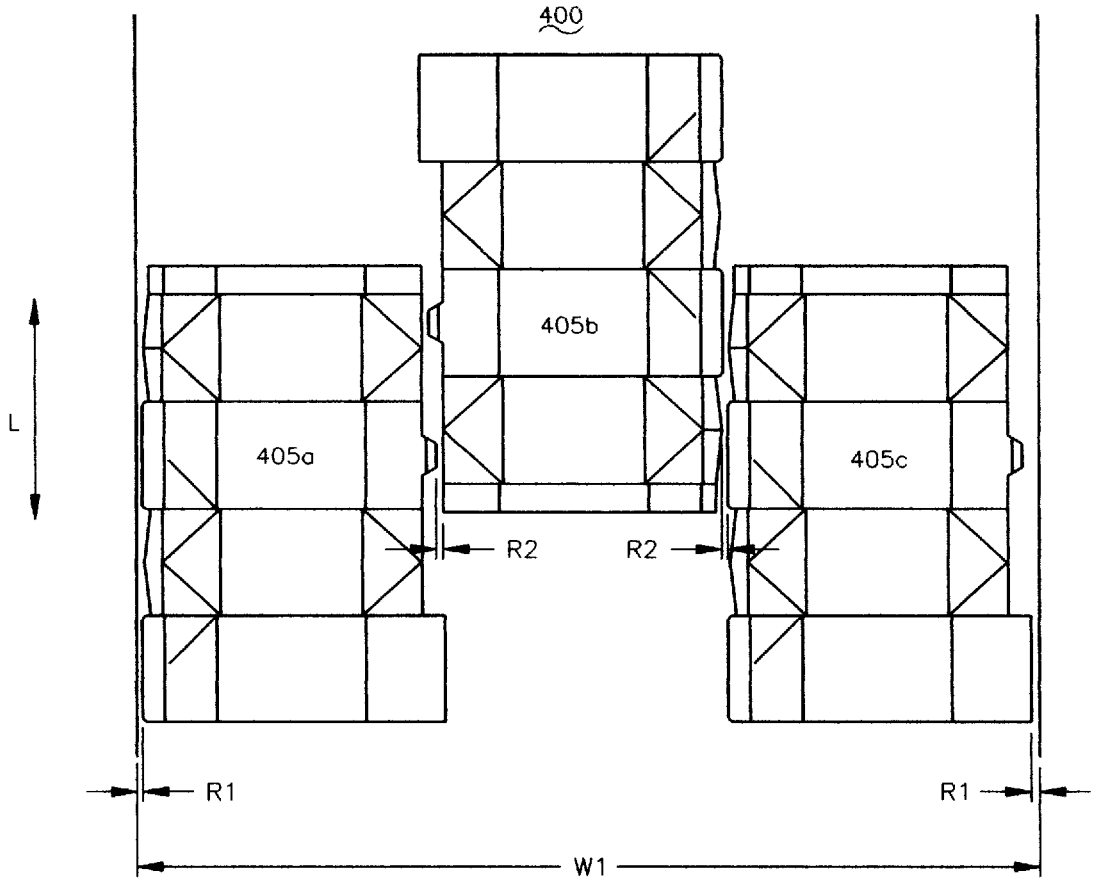
FIG. 8 is a plan view illustrating a plurality of conventional blanks disposed on a web of material.
Figure 9:
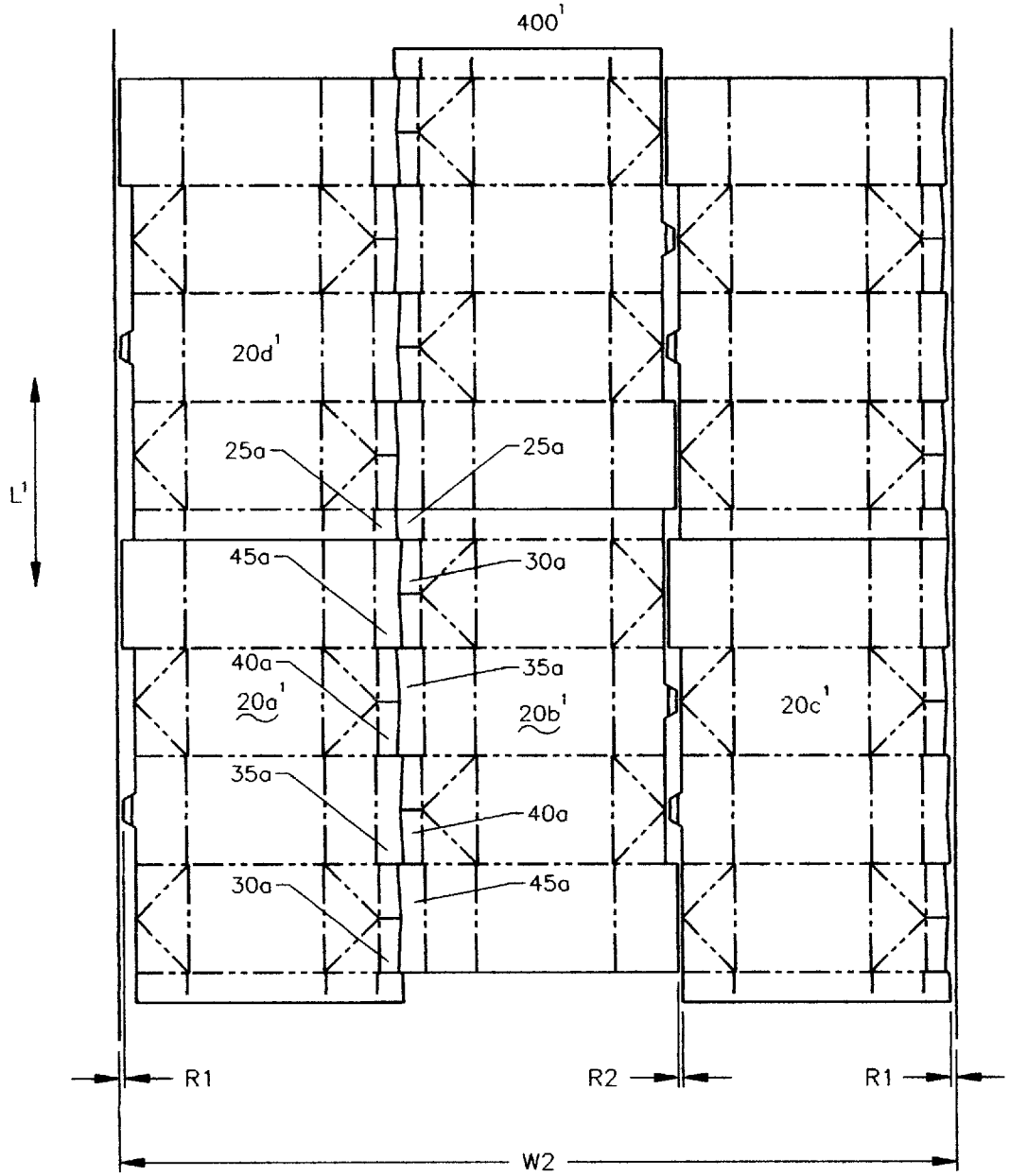
FIG. 9 is a plan view illustrating a plurality of blanks of the type illustrated in FIG. 3 disposed a web of material.
Figure 10:
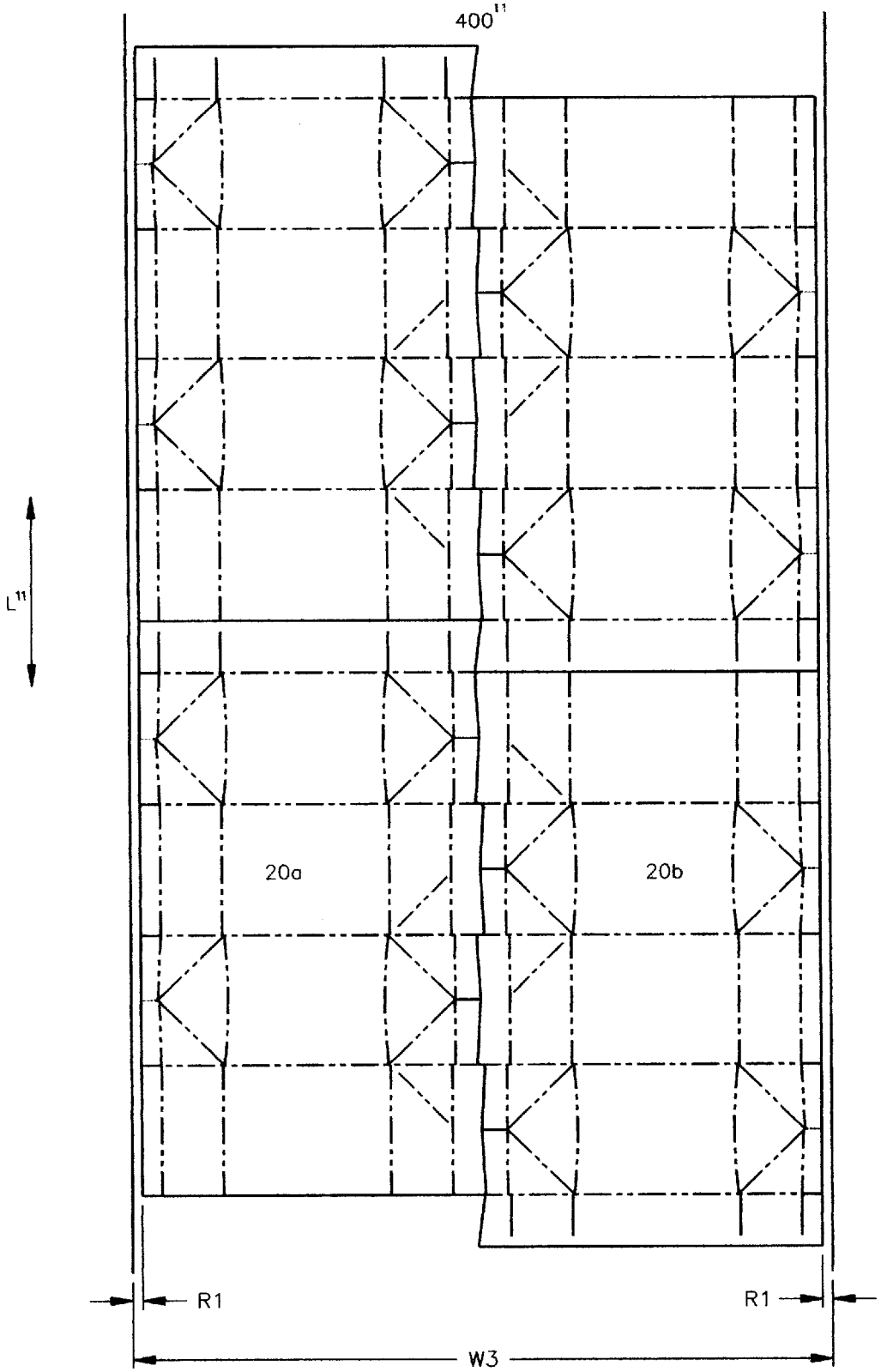
FIG. 10 is a plan view illustrating a plurality of blanks of the type illustrated in FIG. 1 disposed on a web of material.

FIGS. 8–10 are plan views of a series of material roll widths from which blanks of various configurations are formed. These views are selected for comparing the average surface area of blanks of different configurations that are used to form cartons for containing the same predetermined volume of product. In FIG. 8, a standard gable top blank configuration is utilized. FIG. 9 illustrates a web having blanks of the type shown in FIG. 3 while FIG. 10 illustrates a web having blanks of the type shown in FIG. 1.

FIG. 8 shows a material web 400 from which a plurality of carton blanks 405 *a*–*c* are formed. The carton blanks 405 *a*–*c* are of a standard configuration, such as the configuration available for use on TR/6™, TR/7™, TR/8™, Tetra Mini™ packaging machines available from Tetra Rex® Packaging Systems, Inc. The blanks shown and described herein are, for example, used to form containers having a 70×70 mm cross-section. The web 400 has a width designated as W1. Width W1 is the minimum width required to form three carton blanks horizontally along the width. To optimize the use of the available web width, the three blanks 405 *a*–*c* are arranged so that the bottom of the first carton blank 405*a* is disposed adjacent the bottom of the second carton blank 405*b* and the top of the second carton blank 405*b* is disposed adjacent the top of the third carton blank 405*c*. Additionally, the second carton blank 405*b* is offset from the first and third carton blanks 405*a* and 405*c* to further optimize the use of the web area. The carton blanks are repeated in a side-by-side manner along the length L of the web 400.

Certain portions of the web 400 are removed to form the blanks and ensure that the edges of the blanks are structurally sound. More particularly, a predetermined width of material R1 is removed from the edge portions of the web 400 to remove any damaged portions of the web thereby ensuring that the blanks adjacent the web edges are properly formed. Additionally, a continuous strip of material is removed from between blanks. This strip has a minimum width R2, which is selected to be the minimum width that may be used to remove the strip in a continuous manner without transverse tearing.

FIG. 9 shows a material web 400' from which a plurality of carton blanks 20*a*–*c* of the type shown in FIG. 1 are formed. The web 400' has a width designated as W2. Width W2 is the minimum width required to form three carton blanks 20*a*–*c*'. The blanks 20*a*' and 20*b*' are arranged so that the top of the first carton blank 20*a*' is disposed adjacent the top of the second carton blank 20*b*'. As such, the top fin flap 30*a* of carton blank 20*a*' is disposed immediately adjacent the top fin flap 45*a* of the carton blank 20*b*'. The top fin flap 35*a* of carton blank 20*a*' is disposed immediately adjacent the top fin flap 40*a* of carton blank 20*b*'. The top fin flap 40*a* of carton blank 20*a*' is disposed immediately adjacent the top fin flap 35*a* of carton blank 20*b*'. The top fin flap 45*a* of carton blank 20*a*' is disposed immediately adjacent the top fin flat 30*a* of carton blank 20*b*'. The top fin flap 25*a* of carton blank 20*a*' is disposed immediately adjacent the top fin flap 25*a* of a carton blank 20*d*' that is, in turn, disposed immediately at the side of carton blank 20*b*'. The carton blanks are repeated in a side-by side manner along the length of the web L'. The bottom of blank 20*b*' is disposed adjacent the bottom of blank 20*c*'.

Like the web of FIG. 8, the present web 400' has a predetermined width of material R1 that is removed from the edges of the web 400' to remove any damaged portions and thereby ensuring that the blanks adjacent the web edges are properly formed. However, since the top edges of the blanks are interlocked in the illustrated manner, there is no need to remove a continuous strip of material from between them. Instead, it becomes possible to separate the top fin panels of adjacent carton blanks using a continuous knife cut. This is due to the complementary characteristic of the interlocked top fin panels of the adjacent blanks. In accordance with this characteristic, a knife cut that narrows a top fin panel of one of the adjacent blanks desirably increases the width of a corresponding top fin panel of the other of the adjacent blanks while a knife cut that increases the width of a top fin panel of the one of the adjacent blanks desirably decreases the width of a corresponding top fin panel of the other of the adjacent blanks. Thus, the irregular shape of the upper transverse edge 95 of one blank of the web 400' directly corresponds with the irregular shape of the upper transverse edge 95 of an immediately adjacent blank. A continuous strip of material is removed from between blanks 20*b*' and 20*c*'. This strip has a minimum width R2, which is selected to be the minimum width that may be used to remove the strip in a continuous manner without transverse tearing.

A further web of material 400" is illustrated in FIG. 10. The web 400" comprises two blanks 20*a* and 20*b* disposed across the with W3 of the web. The blanks 20*a* and 20*b*, like the blanks 20*a*' and 20*b*' of web 400', are disposed top-to-top and have gabled bottom configurations. The carton blanks are repeated in a side-by side manner along the length of the web L". Like the webs of FIGS. 8 and 9, the present web 400" has a predetermined width of material R1 that is removed from the edges of the web 400" to remove any damaged portions thereby ensuring that the blanks adjacent the web edges are properly formed. However, since the top edges of the blanks are interlocked in the illustrated manner, there is no need to remove a continuous strip of material from between them.

Assuming that the blanks of FIGS. 8 and 9 are designed to contain 8 oz. of product, the width W1 would be approximately 446 mm with a carton repeat length of about 295 mm. The width W2 would be approximately 434.1 mm with a carton repeat length of about 295 mm. In each occurrence, the dimension of R1 would be approximately 3.5 mm while the dimensions of R2 would be approximately 2.5 mm.

It is desirable to calculate the average web area needed for production of a single carton blank. Such a calculation provides a realistic measure of the surface area used in the actual production process.

The average web area calculation involves taking the total web width and dividing it by the number of cartons across the. This value is then multiplied by the repeat length of the carton along the length of the web. Using this approach, the standard carton of FIG. 8 yields a required web area of about 43,856.7 $mm^2$/carton; the carton configuration shown in FIG. 9 yields a required web area of about 42,686.5 $mm^2$/carton. Overall, there is a material space savings approximately between 2.6% and 5.3% when the carton of the present invention is compared to a standard carton of the type shown in FIG. 8.

It will be recognized that the inventive interlocking top fin paneled blanks and the inventive upstanding fin with a centrally disposed depressed region may be used in conjunction with a wide variety of gable-top carton configurations. For example, the foregoing structures may be used in conjunction with the reduced surface gable-top container configurations shown and described in U.S. Ser. No. 08/620,698, filed Mar. 21, 1996, which is hereby incorporated by reference.

Although the present invention has been described with reference to a specific embodiment, those of skill in the art will recognize that changes may be made thereto without departing from the scope and spirit of the invention as set forth in the appended claims.

I claim:

1. A blank for forming a gable top carton, the gable top carton having a plurality of panels partitioned into a plurality of side panels, a plurality of top flap panels and a plurality of bottom flap panels by a plurality of score lines, the blank comprising:

first, second, third, fourth, and fifth top fin panels, each of the top fin panels adjacent a respective top flap panel and terminating at an upper transverse edge of the blank, the top fin panels having a plurality of score lines dividing the top fin panels from one another, the upper transverse edge of each of the second and fourth top fin panels comprising a pair of inclined edges joining one another at an apex and extending respectively from first and second concave sections, the upper transverse edge of the first top fin panel consisting of first and second declined edges joining one another at a first depression, the first declined edge extending from the first depression to a first convex section at a lateral edge of the blank, the second declined edge extending from the first depression to a second convex section adjacent the first concave section of the second top fin panel, the upper edge of the third top fin panel consisting of third and fourth declined edges joining one another at a second depression, the third declined edge extending from a third convex section to the second depression, the third convex section adjacent the second concave section of the second top fin panel, the fourth declined edge extending from the depression to a fourth convex section adjacent the first concave section of the fourth top fin panel.

2. The blank according to claim 1 wherein the upper edge of the fifth top fin panel is a declined edge.

3. A web of material comprising:

a plurality of gable top carton blanks, each of the carton blanks comprising a plurality of panels partitioned by a plurality of score lines into a plurality of side panels, a plurality of top flap panels, a plurality of bottom flap panels, and first, second, third, fourth, and fifth top fin panels, each of the top fin panels adjacent a respective top flap panel and terminating at an upper transverse edge of the blank, the top fin panels having a second plurality of score lines dividing the top fin panels from one another, the upper transverse edge of each of the second and fourth top fin panels comprising a pair of inclined edges joining one another at an apex and extending respectively from first and second concave sections, the upper transverse edge of the first top fin panel consisting of first and second declined edges joining one another at a first depression, the first declined edge extending from the first depression to a first convex section at a lateral edge of the blank, the second declined edge extending from the first depression to a second convex section adjacent the first concave section of the second top fin panel, the upper edge of the third top fin panel consisting of third and fourth declined edges joining one another at a second depression, the third declined edge extending from a third convex section to the second depression, the third convex section adjacent the second concave section of the second top fin panel, the fourth declined edge extending from the depression to a fourth convex section adjacent the first concave section of the fourth top fin panel;

whereby pairs of carton blanks are disposed immediately adjacent one another on the web of material in a top-to-top alignment in which the irregular cut of the upper transverse edge of a first one of a pair of adjacent carton blanks directly matches the irregular cut of the transverse edge of a second one of the pair of adjacent carton blanks.

4. The web of material according to claim 3 wherein the web of material is composed of a fiberboard material coated with polyethylene.

* * * * *